United States Patent [19]

Boyne et al.

[11] 4,230,447

[45] Oct. 28, 1980

[54] FLARED COMBUSTION CHAMBER

[75] Inventors: Ralph A. Boyne, Haywards Heath; Richard L. Cottingham, Piltdown, Nr. Uckfield, both of England

[73] Assignee: Thormack Engineering Ltd., Uckfield, England

[21] Appl. No.: 901,231

[22] Filed: Apr. 28, 1978

[30] Foreign Application Priority Data

Apr. 27, 1977 [GB] United Kingdom ..... 17683/77

[51] Int. Cl.[3] ..... F23R 1/04

[52] U.S. Cl. ..... 431/158; 126/271.2 A

[58] Field of Search ..... 431/158, 157, 264, 263; 126/271.1, 271.2 A; 239/598, 566

[56] References Cited

U.S. PATENT DOCUMENTS

| | | | |
|---|---|---|---|
| 2,308,887 | 1/1943 | McCollum | 431/157 |
| 2,525,055 | 10/1950 | Ward, Jr. | 239/566 |
| 2,821,976 | 2/1958 | Fizzell | 126/271.2 A |
| 3,132,642 | 5/1964 | Fingland | 126/271.2 A |
| 3,156,454 | 11/1964 | Flynn | 431/158 |
| 3,251,394 | 5/1966 | Thorpe et al. | 431/158 |
| 3,385,381 | 5/1968 | Calaman | 431/158 |
| 3,400,893 | 9/1968 | Labino | 431/158 |
| 3,454,426 | 7/1969 | Taylor | 431/158 |
| 3,534,725 | 10/1970 | Davis, Jr. et al. | 126/271.2 A |
| 3,736,094 | 5/1973 | Shisler | 431/158 |
| 3,926,544 | 12/1975 | Thorpe | 431/158 |

*Primary Examiner*—Carroll B. Dority, Jr.
*Assistant Examiner*—Lee E. Barrett
*Attorney, Agent, or Firm*—Fleit & Jacobson

[57] ABSTRACT

Apparatus for producing a high velocity stream of gas, for example, for treating a road surface, including an elongate combustion chamber having, along its lower surface, a plurality of discharge orifices, preferably arranged in a line, means to feed combustion gases into the upper portion of the combustion chamber and means to deflect the incoming gases, so that they are distributed within the combustion chamber prior to leaving the combustion chamber through the discharge orifices.

9 Claims, 2 Drawing Figures

FLARED COMBUSTION CHAMBER

Figure 1:
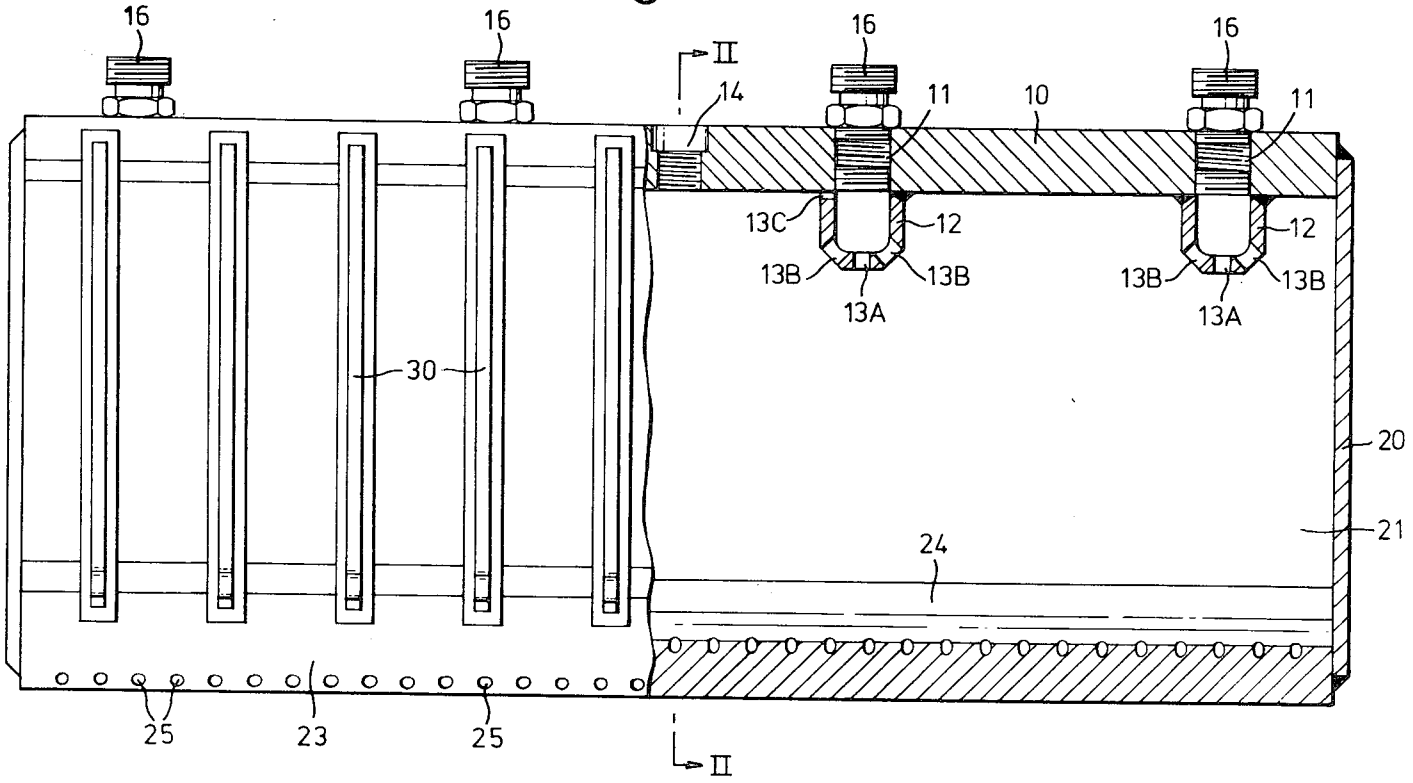

The present invention relates to apparatus for projecting a high velocity stream of hot gas.

It is often convenient to heat up a surface by a stream of hot gas to carry out certain work thereon. For example, it is convenient to project a stream of hot gas at a road surface to remove glaze therefrom. This can be done, for example, by simply heating the road surface with downwardly projecting flames in a manner similar to that used for laying tarmac. However, this is generally unsatisfactory as it tends either to leave the tar on the surface, thus increasing the glazed effect, or to loosen the chippings on the road, since it melts the tar thereunder.

It has also been proposed to use a flash back type heater which projects a high velocity jet of combustion gases against the road surface. This has considerable advantages over methods used previously insofar as it sweeps the molten tar away from the surface and one can actually see whether or not one is removing the pebbles or the like from the tarmac surface. However, it can be a rather laborious task if one is dealing with a very large area of roadway.

It is now proposed, according to the present invention, to provide apparatus for producing a high velocity stream of gas including an elongate combustion chamber having, along its lower surface, a plurality of discharge orifices, means to feed combustion gases into the upper portion of the combustion chamber and means to deflect the incoming gases, so that they are distributed within the combustion chamber prior to leaving the combustion chamber through the discharge orifices.

In a preferred construction, the discharge orifices are arranged in a line and the combustion chamber is horizontally elongate, having side walls which advantageously converge towards one another in a direction towards the discharge orifices.

The combustion chamber may be fed through one or more inlets and means may be provided to ignite the combustion gases as they enter. In a preferred construction, the upper end of the combustion chamber is provided with four inlet orifices substantially equally spaced from one another, the inlet orifices being provided with a distributor rose in the form of a tube which is open at its top, to receive combustion air and fuel from the inlet orifices, and is closed at its bottom, having a number of radially extending apertures for the discharge of the gas into the combustion chamber. In one construction it is contemplated having four such apertures. One or more sparking plugs may then be provided, the roses then having ignition apertures which project the combustion air and fuel towards the spark plug or plugs in the course of lighting up of the device.

Preferably the discharge orifices are provided in a bar extending along the lower edge of the combustion chamber, this bar having a rounded bottom and the orifices opening, at their upper end, into a downwardly convergent channel. In one construction this channel has an apex angle of 150° and in another construction the channel is of semi-circular cross-section.

In order to project the gas to one side, to cause less danger to the operator, it may be advantageous to arrange the orifices inclined to one side. For example, when one desires to do this, it has been found convenient to use an angle of about 15° to 30° to the vertical.

The combustion chamber is advantageously provided with cooling ribs on its external surface. These cooling ribs may, for example, be vertically extending ribs on each of the side walls of the combustion chamber.

The apparatus may be mounted on a suitable trolley to enable it to be moved relatively along a roadway. It is contemplated that the dimensions of the combustion chamber will be approximately 20 inches in length by 6 inches in height.

The construction of the present invention is particularly suitable for removing the glaze from roadways and for carrying out similar work thereon. It has also been found extremely useful for drying off a road surface immediately prior to applying a marking material, such as a white or yellow marking material. In this way the apparatus of the present invention can be used to precede the marking of a roadway even in the rain.

Figure 2:
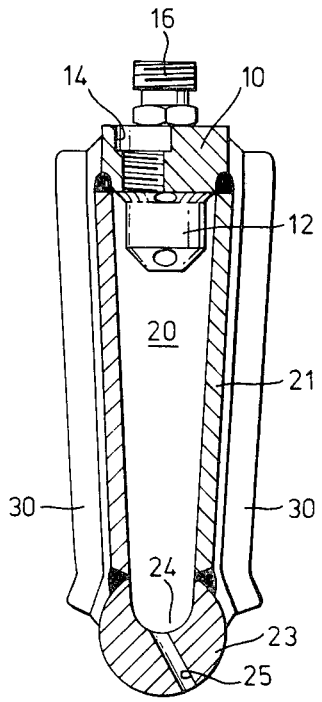

In order that the invention may more readily be understood, the following description is given, merely by way of example, reference being made to the accompanying drawings in which:

FIG. 1 is a side elevation, partly shown in cross-section, of one embodiment of apparatus according to the invention; and FIG. 2 is a cross-section taken along the line II—II of the apparatus of FIG. 1.

The apparatus illustrated in the drawings comprises a top member 10 having bored therein four aligned equally spaced holes 11 which are tapped. These holes are each covered, at their lower ends, by caps 12 welded thereover, these caps each having an axial aperture 13 A and two angled apertures 13 B. The innermost two of the caps 12 also have a radial hole 13 C directed towards the centre of the top member. The holes 13 A and 13 B provide a "rose" effect. A further central hole 14 is provided between the two innermost holes 11, this hole 14 being tapped and provided at the upper end with a countersink to enable a conventional spark plug to be inserted therein.

Welded to the top member 10 are two end members 20 and two inclined convergent plates 21 as can be seen more clearly in FIG. 2. The plates 20 and 21 are all welded at their bottoms to a discharge bar 23. Thus, the roses are all enclosed within a combustion chamber formed thereby.

The discharge bar 23 is provided with a rounded lower surface of substantially semicylindrical configuration and a semicylindrical channel 24 on the upper surface. Thirtytwo discharge orifices 25 are bored in the discharge bar from approximately the centre of the semicylindrical upper surface at an angle of approximately 30° to the vertical.

In use of the above described apparatus, the inlet holes 11 are connected by pipe fittings 16 and further pipework (not shown) to a source of fuel gas, for example, propane or butane, and to a source of compressed air. The combustion mixture thus provided is projected into the housing and escapes through the apertures 13 C in the two centre roses. The combustible mixture thereby passes over the spark plug whereby it is ignited and the expanded gases produced by the combustion are projected at a very high velocity indeed out of the discharge orifices 25. The discharge gas is projected at an angle to the vertical so that it can be arranged to be directed away from the operator.

The sizes of the inlet holes 11 and the discharge orifices 25 are chosen so that the total area for escape of the combusted gas from the combustion chamber is approximately twice the total area for the air and fuel to arrive through the four inlet orifices This assists in ensuring that there is no blowback along the supply lines. Desirably, however, non-return valves are provided to ensure that there will be no blowback.

It has been found that the apparatus of the present invention is particularly suitable for use in treating roadways and the like. The blast of hot gas coming out at near sonic speeds causes a melting of the tar on the surface of the road and blows the tar away from the point of contact. This ensures that the roadway will not subsequently be glazed. The operator can see as he moves the apparatus along how he is working and can be sufficiently fast to ensure that the tar is not removed from the bottom of the chips on the road and thus he can make sure that these chips will not be loosened. The fine control of the flow of gases is such as to enable the operator to work closely adjacent to white lines in the road without damaging them and indeed to work closely adjacent to cats eyes markers and the like without any damage to them either.

It is contemplated that the apparatus of the present invention can have other uses including removing the white or yellow line marking from the roadway and removing tar, rubber etc., from the surfaces such as airport runways. The apparatus can also be used for drying the road out before the application of white or yellow line marking.

In order to cool off the combustion chamber, a number of parallel ribs 30 are welded to the external surface of the side walls 21.

We claim:

1. Apparatus for producing a high velocity stream of gas, said apparatus comprising:

(a) a narrow, enclosed combustion chamber which is horizontally elongate and vertically elongate and has an upper portion and a lower surface;

(b) means defining a multiplicity of discharge orifices through said lower surface arranged in a substantially straight line;

(c) a plurality of horizontally spaced inlets for feeding a combustible gas mixture into the upper portion of the combustion chamber;

(d) means enabling the combustion mixture to be ignited within said chamber whereby, in use, combustion of the mixture takes place wholly within the chamber; and (e) means to deflect the incoming gas mixture, so that it is distributed within the combustion chamber, and whereby the products of combustion leave the combustion chamber through the discharge orifices.

2. Apparatus as claimed in claim 1, wherein said narrow enclosed combustion chamber comprises side walls which converge towards one another in a direction towards the discharge orifices.

3. Apparatus as claimed in claim 1, wherein the means enabling the combustion mixture to be ignited comprises a spark plug located in said combustion chamber.

4. Apparatus as claimed in claim 1, wherein there are four of said horizontally spaced inlets which are substantially equally spaced from one another, and further comprising a distributor rose in said combustion chamber covering each said inlet.

5. Apparatus as claimed in claim 4, wherein each said distributor rose is in the form of a tube which is open at the top, to receive combustion air and gas from the associated inlet and is closed at its bottom, said tube having a number of apertures in its side wall for the discharge of gas into the combustion chamber.

6. Apparatus as claimed in claim 1, wherein said lower surface is defined by a bar extending along the combustion chamber, said bar having a rounded bottom and downwardly converse channel shaped top, said discharge orifice extending from said channel to said bottom.

7. Apparatus as claimed in claim 1, wherein said orifices are inclined to one side of the combustion chamber, at an angle of 15° to 30° to the vertical.

8. Apparatus as claimed in claim 1, and further comprising cooling ribs on the external surface of the combustion chamber.

9. Apparatus as claimed in claim 8, wherein said cooling ribs extend vertically on each side of the combustion chamber.

* * * * *